US005548261A

United States Patent [19]

Ulerich et al.

[11] Patent Number: 5,548,261

[45] Date of Patent: Aug. 20, 1996

[54] TRIP DEVICE FOR A CIRCUIT BREAKER

[75] Inventors: Phillip L. Ulerich, Pittsburgh; Kathryn M. Palmer, Monroeville; Edward F. Docherty, Pittsburgh, all of Pa.

[73] Assignee: Eaton Corporation, Cleveland, Ohio

[21] Appl. No.: 397,807

[22] Filed: Mar. 3, 1995

[51] Int. Cl.[6] ..... H01H 9/00

[52] U.S. Cl. ..... 335/172; 335/167

[58] Field of Search ..... 335/167.76, 23–25

[56] References Cited

U.S. PATENT DOCUMENTS

| | | | |
|---|---|---|---|
| 3,544,931 | 12/1970 | Patel . | |
| 3,590,192 | 6/1971 | Bould et al. . | |
| 3,600,540 | 8/1971 | Bould . | |
| 3,689,721 | 9/1972 | McGuffie . | |
| 3,832,504 | 8/1974 | Cellerini et al. . | |
| 4,162,385 | 7/1979 | Bould et al. . | |
| 4,163,133 | 7/1979 | Bould . | |
| 4,489,295 | 12/1984 | Altenhof, Jr. et al. . | |
| 4,638,277 | 1/1987 | Thomas et al. . | |
| 4,641,001 | 2/1987 | Fujihisa et al. | 335/175 |
| 4,642,430 | 2/1987 | Tedesco . | |
| 4,656,444 | 4/1987 | McKee et al. . | |
| 4,679,018 | 7/1987 | McKee et al. . | |
| 4,691,182 | 9/1987 | Mrenna et al. . | |
| 4,698,606 | 10/1987 | Mrenna et al. . | |
| 4,725,800 | 2/1988 | Grunert et al. . | |
| 4,963,846 | 10/1990 | Grunert et al. . | |
| 5,294,903 | 3/1994 | Bosch et al. | 335/172 |

*Primary Examiner*—Lincoln Donovan
*Attorney, Agent, or Firm*—Martin J. Moran

[57] ABSTRACT

An improved trip device for operating a trip mechanism which, in turn, operates a circuit breaker mechanism for opening a set of electrical contacts. The trip device includes a spring-biased actuating rod which is mechanically operated by a solenoid. The actuating rod has a notched end which is secured by a rotatable shaft at a notch portion of the shaft. The shaft has latch arms, and the core of the solenoid has projections extending into slots in the latch arms. When the solenoid receives a faulty current signal, the core moves and causes the projections to forcibly impact against the latch arms which rotates the shaft, whereby the notch portion of the shaft aligns with the notched end of the actuating rod and the actuating rod reciprocally moves into the notched portion of the shaft thereby actuating the trip mechanism.

11 Claims, 6 Drawing Sheets

TRIP DEVICE FOR A CIRCUIT BREAKER

BACKGROUND OF THE INVENTION

1. Field of the Invention

This invention relates to a circuit breaker and more particularly relates to an improved trip device for operating a circuit breaker mechanism to automatically open the contacts of a circuit breaker.

2. Description of the Prior Art

A trip device for tripping a circuit breaker is generally an electromagnetic device which is used to mechanically trip a circuit breaker mechanism to open the electrical contacts when the device is pulsed by a momentary low energy electrical signal supplied under abnormal or overload conditions.

In general, a trip device must be designed to reliably trip the circuit breaker mechanism under the worst set of conditions where there is a minimum capacitance and capacitor voltage, and not to be accidentally activated or triggered due to shock or vibration in the circuit breaker.

A trip device of the prior art is a magnetic trip device which is comprised of a movable keeper connected to an actuator, which when the movable keeper is released, moves as a unit to engage a trip extension that is carried on the breaker trip shaft to move the trip shaft and thereby effect opening of the breaker contacts. The magnetic trip device comprises a generally U-shaped unitary magnetic member and a movable keeper opposite the ends of the legs of the generally U-shaped unitary magnetic member with the bight portion of the generally U-shaped unitary magnetic member serving as a fixed keeper. This type of magnetic trip device is disclosed in U.S. Pat. No. 3,544,931 assigned to Westinghouse Electric Corporation and issued to N. J. Patel on Dec. 1, 1970.

One of the drawbacks of this trip device of U.S. Pat. No. 3,544,931 is that the manufacturing process requires drilling, grinding, plating and potting operations. These operations require extensive labor which translates into a substantial cost for manufacturing this trip device of the prior art. Also, the activation energy for the device, which is the energy needed to activate the device, may vary greatly. The device may generally be prone to unwanted tripping or may not trip when necessary. Also, this trip device employs a permanent magnet which tends to be costly, may be tripped by a voltage ranging from 15 to 25 volts, and may be tripped by extreme shocks and/or vibrations in a circuit breaker.

There remains, therefore, a need for a trip device for opening the electrical contacts of a circuit breaker which eliminates at least some or all of the above labor extensive operations presently required in manufacturing the trip device of the prior art, thereby reducing costs.

There also remains a need for a trip device which is activated when necessary and which still reliably holds and is not accidentally activated under extreme shock and/or vibration conditions normally occurring in a circuit breaker.

SUMMARY OF THE INVENTION

The present invention obviates or ameliorates the aforementioned shortcomings of the prior art by providing an improved design for a trip device.

This improved design for a trip device employs a solenoid and uses the kinetic energy theory to determine the instantaneous velocity required for movement of a core in the solenoid for indirectly activating an actuating rod which actuates a rotatable trip shaft of a circuit breaker to effect a tripping operation of the circuit breaker resulting in the opening of the electrical contacts.

The trip device of the present invention is comprised of a spring biased actuating rod which has a notched end which is generally secured to a rotatable shaft at a notch portion of the shaft. The shaft has latch arm means. A solenoid includes a core with projection means at its one end which is spaced away from the latch arm means. When the solenoid receives a faulty current signal, the core means moves and causes its projection means to forcibly contact the latch arm means which rotates the shaft, whereby the notch portion of the shaft aligns with the notched end of the actuating rod, and the rod is forced by the compressed spring to move thereby actuating the trip mechanism.

A gap which exists between the projection means and the latch arm means prior to the trip device being activated by the faulty current signal is preset or predetermined according to the required instantaneous velocity of the core at the moment of impact of the projection means against the latch arm means to overcome the frictional forces in the system of the trip device and to rotate the latch arm means. This instantaneous velocity is derived from the kinetic energy in the system where $$v=\left(2\cdot\frac{fnd}{m}\right)^{1/2}$$

where v is the required instantaneous velocity for the core means when contacting the latch arm means, f is the coefficient of friction in the trip device, n is the normal force of the actuating rod against the shaft, d is the distance of the gap between the projection means of the core and the latch arm means, and m is the moving mass of the core.

It is, therefore, an object of the invention to provide a low cost, low energy trip device for a circuit breaker.

It is a further object of the present invention to provide an improved trip device for a circuit breaker which is more economical to manufacture requiring less labor operations than those of the prior art devices.

A further object of the present invention is to provide a solenoid operation trip device which employs the kinetic energy theory to mechanically operate an actuator of the trip device.

More particularly, the present invention employs the energy balance equation for the system of the trip device to derive the required instantaneous velocity for the projection means on a core of the solenoid means to adequately rotate latch arm means of the trip device at the instant of impact of the projection means against the latch arm means, thereby resisting stalling or non-activation of the trip device, whereby this instantaneous velocity is obtained as the solenoid converts electrical energy to kinetic energy through the amount of spacing between the projection means and the latch arm means prior to activation by the solenoid means.

A still further object of the present invention is to provide an improved trip device which is certain to be activated by a predetermined voltage value.

These and other objects of the present invention will be more fully understood and appreciated from the following description of the present invention upon reference to the illustrations appended hereto.

DETAILED DESCRIPTION OF THE PREFERRED EMBODIMENT

Figure 1:
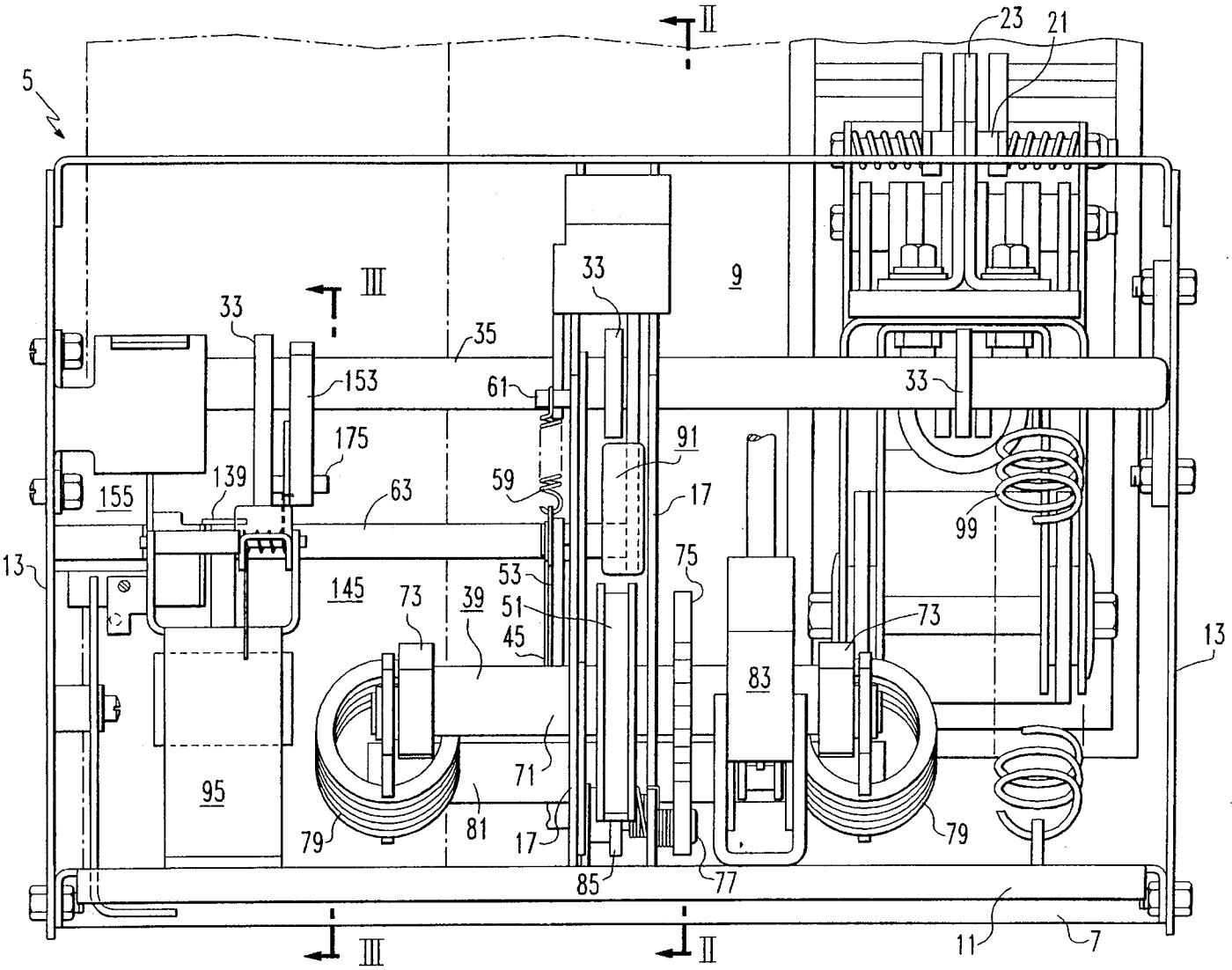
FIG. 1 is an end view, with pans broken away, of a circuit brewer employing the trip device of the present invention.
Figure 2:
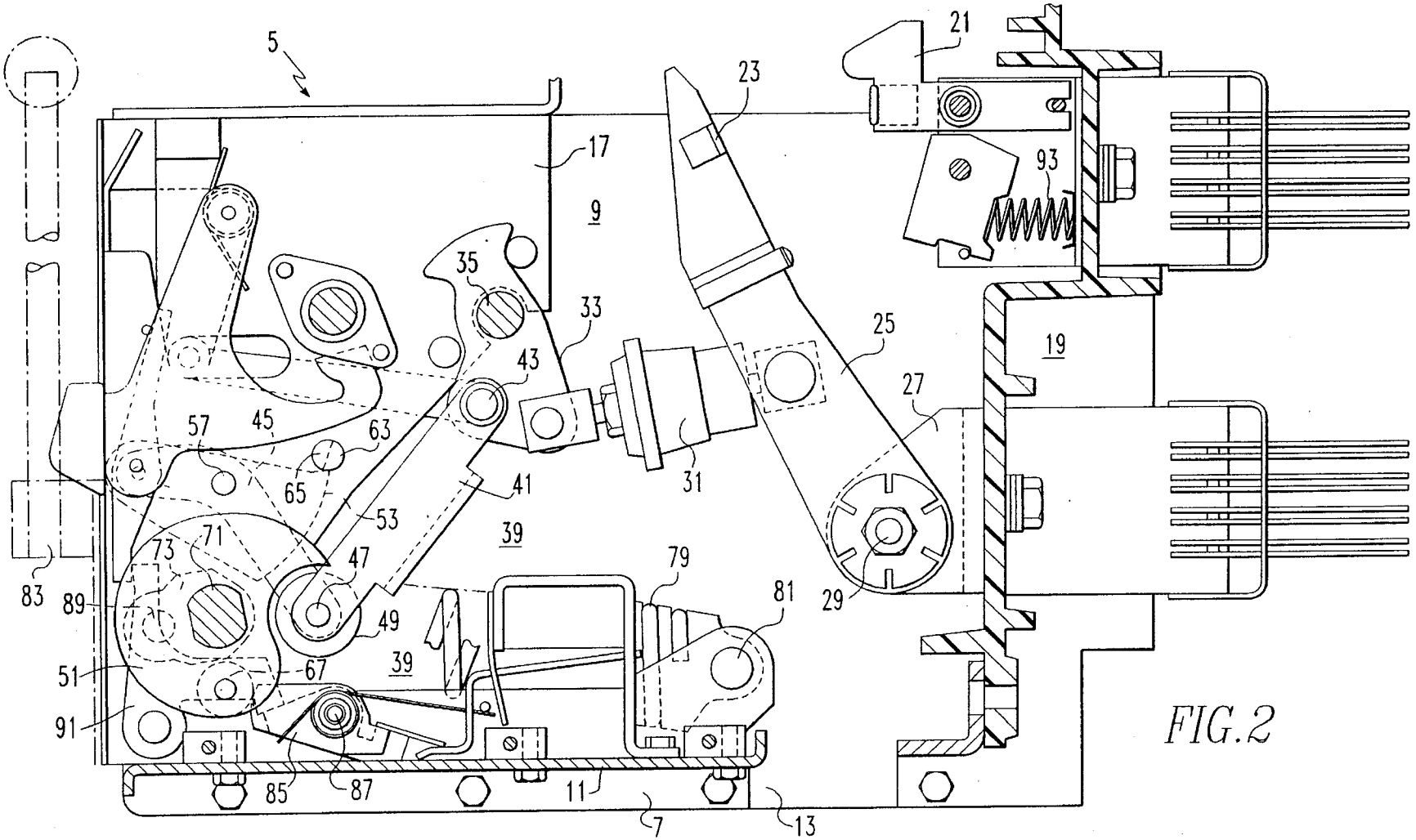
FIG. 2 is a sectional view taken generally along lines II—II of FIG. 1.

Referring to the drawings, there is shown in FIGS. 1 and 2 a three-pole circuit breaker 5 comprising a housing structure 7 and a circuit-breaker structure 9 supported on the housing structure 7.

The housing structure 7 comprises a metallic base plate 11, a pair of spaced metallic side plates 13 secured to flanges of the base plate 11, a pair of metallic spaced center plates 17 secured to the base plate 11 and a back wall structure indicated generally at 19.

The circuit-breaker structure 9 is a three-pole structure comprising a stationary contact 21 and a movable contact 23 for each pole unit. Each of the movable contacts 23 is supported on a conducting contact arm 25 that is pivotally supported on a terminal conductor 27 by support means 29. In each pole unit, a separate insulating connecting member 31 is pivotally connected at one end thereof to the contact arm 25 and at the other end thereof to a lever 33 that is welded to a common jack shaft or tie bar 35. As can be seen in FIG. 1, the jack shaft 35 extends across all of the poles of the circuit breaker, and there is a separate lever 33 for each pole unit welded to the jack shaft 35. Only one of the contact structures is shown in FIG. 1. The contact structures for the center-pole and for the left-hand (FIG. 1) pole are left off of the drawing in FIG. 1 merely for the purpose of clarity. It can be understood that the contact structures for all three pole units are the same as the one contact structure shown in FIGS. 1 and 2.

The jack shaft 35 is supported for pivotal movement about the elongated axis thereof, on the side plates 13 and center plates 17. The connecting members 31, levers 33 and jack shaft 35 are part of a stored-energy spring closing mechanism 39 that is operable to close the contact 23, 21.

The mechanism 39 comprises a link member 41 that is pivotally connected, at one end thereof, to lever 33 of the centerpole unit by means of a pin 43. The link 41 is pivotally connected, at the other end thereof, to a link 45 by means of a knee pivot pin 47. A roller member 49, that serves as a cam follower, is mounted on the pin 47 to cooperate with a closing cam 51. A link 45 is pivotally connected at the other end thereof to a latch member 53 by means of a pin (not shown). The latch member 53 is mounted for pivotal movement about a fixed pivot 57 that is supported on the left-hand (FIG. 1) center plate 17. As particularly shown in FIG. 1, a tension spring 59 is connected at one end thereof to a stationary pin 61, and operatively connected to the same pin interconnecting link 45 with latch member 53 in order to reset the linkage following a tripping operation in a manner described in the aforesaid U.S. Pat. No. 3,544,931. Further details of tile structure and operation of closing mechanism 39 and details of the other components of the circuit breaker 5 are fully disclosed in the above-discussed U.S. Pat. No. 3,544,931, which is incorporated herein by reference.

As shown in FIG. 2, the latch member 53 engages a trip shaft 63 that is a rod with a cut-out portion 65 near where the latch 53 engages the periphery of the trip shaft 63. The cut-out portion 65 is provided so that when the trip shaft 63 is rotated in a counterclockwise direction with reference to FIG. 2, the latch member 53 will be free to move to a tripped position. The trip shaft 63 is supported for pivotal movement about the elongated axis thereof between one of the center plates 17 and one of the side plates 13, as shown in FIG. 1.

Still referring to FIG. 1, the closing cam 51 comprises a pair of twin cam plates and a center spacer plate sandwiched together. The center spacer plate does not fill the space between the twin cam plates, and a roller latch member 67 (FIG. 2) is rotatably supported on and between the twin plates of the cam 51. The cam member 51 is fixedly secured to a crankshaft 71 that is rotatably supported on suitable bearings that are secured to the center plates 17. A pair of crank arms 73 are fixedly mounted on the crankshaft 71 in proximity to the opposite ends of the crankshaft 71. A ratchet member 75 is fixedly mounted on the crankshaft 71, and a pawl 77 is supported on one center plate to cooperate with the ratchet 75. A separate tension spring 79 is operatively connected at one end thereof to each of the crank arms 73. Each of the tension springs 79 is connected, at the other end thereof, to a rod 81 that is secured to the center plates 17. A handle operating mechanism, indicated generally at 83, is provided for manually charging the closing springs 79. As particularly shown in FIG. 2, a latch member 85 is pivotally mounted on a pin 87 and biased in a clockwise direction to the latching position wherein the latch 85 engages the roller 67 to latch the closing cam 51 and crankshaft 71 to prevent counterclockwise movement of the closing cam 51 and crankshaft 71.

The circuit breaker 5 is shown in FIG. 2 in the contact-open position with the stored energy closing springs 79 in the charged condition. As shown in FIG. 2, the spring support pins 89 of the movable ends of the tension springs 79 are below a line through the center of the spring support rod 81 and the center of the crankshaft 71 so that the charged tension springs 79 are operating to bias the crankshaft 71 in a counterclockwise direction. Counterclockwise movement of the crankshaft 71 is prevented by the engagement of the latch member 85 with the latch roller 67 that is mounted on the closing cam 51. The latch member 85 is manually operated to the unlatching position by operation of closing means indicated generally at 91. As shown in FIG. 2, the roller 49 is positioned in a depression of the surface of the closing cam 51. When it is desired to close the circuit breaker, the closing means 91 is manually operated to pivot the latch 85 (FIG. 2) in a counterclockwise direction to thereby release the roller 67. When the roller 67 is released, the closing cam 51 and crankshaft 71 are free to rotate in a counterclockwise direction, and the closing springs 79, operating on the crank arms 73, operate to rotate the crankshaft 87 from the charged position shown in FIG. 2 to the discharged position shown in FIG. 5. With the latch 53 engaging the trip shaft 63 to prevent counterclockwise movement of the latch 53, the closing cam 51 will force the roller 49, and the link 41, to the closed position. During this closing movement of the link 41, the lever 33 (FIG. 2) of the center pole unit is forced in a counterclockwise direction to rotate the jack shaft 35 to a closed position. As the jack shaft 35 rotates to the closed position all three of the levers 33 of the three pole units are moved with the jack shaft 35 to the closed position forcing the connecting members 31 of the three pole units to force the contact arms 25 of the three pole units about the pivots 29 to the closed position wherein the movable contacts 23 engage the stationary contacts 21. This closing movement compresses backup springs 93 in the three pole units. The engagement of the closing cam 51 with the roller 49 serves to prop the link member 41 in the closed position to thereby maintain the jack shaft 35 and contacts in the closed position.

With the contacts 21, 23 in the closed position and the stored energy closing springs 79 in a discharged condition, the circuit breaker 5 may be automatically tripped open in response to an overload above a predetermined value in any of the pole units, by operation of trip means indicated generally at 95 (FIG. 1), that will be hereinafter more specifically described. When actuated, the trip means 95 operates to rotate the trip shaft 63 in a counterclockwise direction from a latching position seen in FIG. 4 to an unlatched or tripped position seen in FIG. 5. With particular reference to FIG. 1, when the trip shaft 63 is rotated counterclockwise to the tripped position of FIGS. 1 and 5, the trip shaft 63 moves to permit the latch member 53 to move in the notch 65 thereby permitting the latch member 53 to move in a counterclockwise direction about the pivot 57. The compressed contact springs 93 and an opening spring 99 (FIG. 1) then operate to move the contact arms 25 toward the open position which movement occurs in a manner so that the link 45 can move to the tripped position with the toggle 41, 45 collapsing to permit the lever 33 to move in a clockwise direction to the tripped open position. Movement of the trip shaft 63 to the tripped position permits the members 41, 45, 53 to move to the tripped position wherein the roller 49 and link 41 no longer restrain the lever 33 in the closed position, and the springs 93, 99 operate to move the jack shaft 35 and the three contact arms 25 to the tripped-open position.

As mentioned above, a full description of the components and their operation are discussed in the above-mentioned U.S. Pat. No. 3,544,931.

Figure 3:
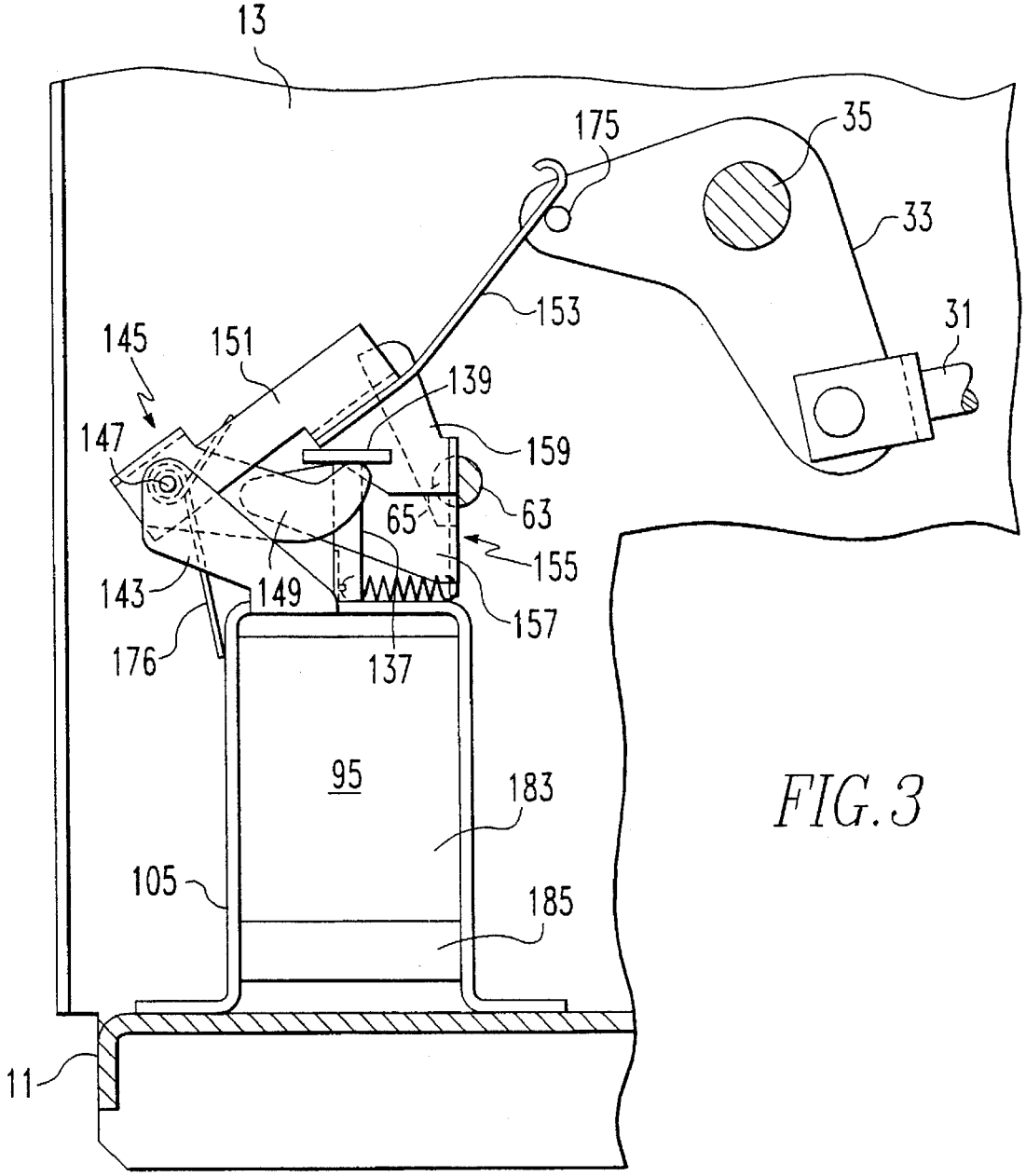
FIG. 3 is a sectional view taken generally along III—III of FIG. 1, with the trip device of the present invention in a reset position.

Referring now to FIG. 3, the trip device 95 is mounted on base plate 11 through an inverted U-shaped housing 105, and is comprised of an actuating rod 137. A supporting bracket 143 (FIG. 3) is fixedly secured to the bight portion of the member 105 and a resilient bellcrank reset member 145 is pivotally supported on and between the legs of the support bracket 143 by means of a pin 147. The bellcrank reset member 145 comprises a rigid lower leg 149 that is positioned under an actuating head 139 of the rod 137, and a rigid upper leg 151 that supports a resilient leaf spring member 153 at the free end thereof. A trip member 155, comprising a lower leg 157 that is positioned under the actuating head 139 of the rod 137 and an upper leg 159, is fixedly secured to the trip shaft 63 at a notch portion 65 of the trip shaft 63. As can be seen in FIG. 3, the lever 33 for the left-hand (FIG. 1) pole unit is shaped with an extension that receives a rigid pin 175 that is fixedly secured to the lever 33 to cooperate with the leaf spring 153 in a manner to be hereinafter described. FIG. 3 shows the circuit breaker 5 of FIG. 1 in an open position for electrical contacts 21 and 23, and trip device 95 in a reset position.

Figure 4:
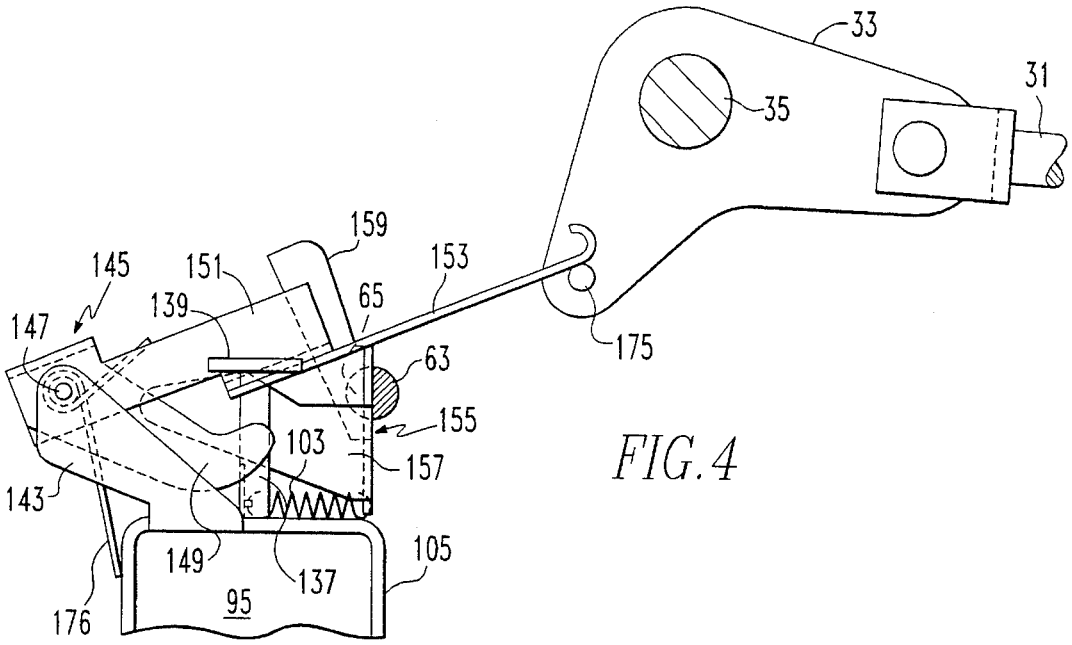
FIG. 4 is a partial view similar to FIG. 3 on an enlarged scale with the circuit breaker in the closed position and the trip device of the present invention in a latched position.

FIG. 4 shows the circuit breaker 5 of FIGS. 1 and 2 in a contact-closed position and trip device 95 in a latched position with trip shaft 63 in the reset latched position. The bell-crank resilient set member 145 is pivoted clockwise by means of torsion spring 176 to the position shown wherein the resilient leaf-spring 153 resets on pin 175. Actuating rod 137 is in the same position as shown in FIG. 3 and with lower leg 157 of trip member 155 being positioned under actuating head 139 of actuating rod 137.

Figure 5:
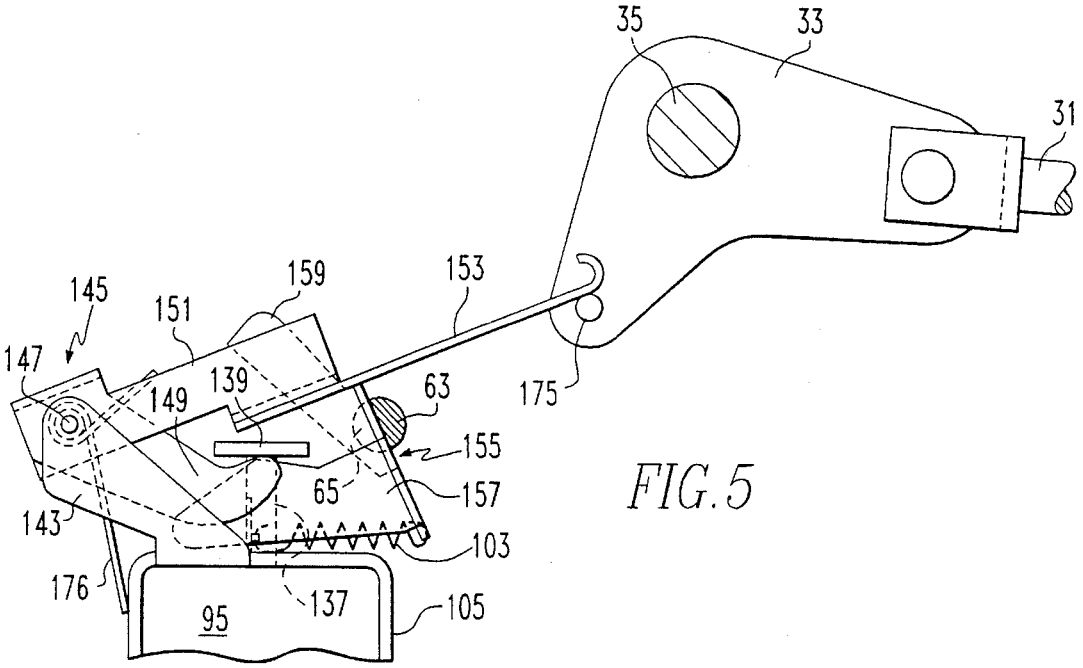
FIG. 5 is a partial view similar to FIG. 3 on an enlarged scale relative to FIG. 3 with the trip device of the present invention in the tripped position just prior to opening of the circuit breaker.

FIG. 5 shows circuit breaker 5 of FIGS. 1 and 2 in a pre-open, contact position and trip device 95 in a tripped position. As can be understood from FIGS. 4 and 5, when trip device 95 is operated to the tripping position the actuating rod 137 moves downward and the actuating head 139 thereof engages the leg 157 of the trip member 155 to pivot the trip shaft 63 in a counterclockwise direction from the position seen in FIG. 4 to the position seen in FIG. 5. This movement of the trip shaft 63 moves the notch portion 65 of trip shaft 63 to effect a tripping operation of the circuit breaker 5. The parts are shown in FIG. 5 at the instant that the trip shaft 63 is moved to the tripping position and just prior to the actual movement of the contacts 21, 23 to the open position since the lever 33 is still shown in the closed position in FIG. 5. Upon movement of the trip shaft 63 to the tripping position seen in FIG. 5, the circuit breaker 5 will be tripped open and the lever 33 will move from the closed position seen in FIG. 5 to the open position seen in FIG. 3. As the lever 33 pivots to the open position seen in FIG. 3 the pin 175 will operate against the resilient leaf spring 153 to pivot the bellcrank resilient reset member 145 from the position seen in FIG. 5 to the reset position seen in FIG. 3 during which movement the leg 149 of the bellcrank reset member 145 engages the actuating head 139 of the actuating rod 137 to move the rod 137 upward to the reset position. With the actuating head rod 137 in the upper position seen in FIG. 3, the trip shaft 63 is free to be reset.

As stated hereinabove, the operation of these several components of the circuit breaker 5 apart from the internal operation of trip device 95 is discussed in the aforementioned U.S. Pat. No. 3,544,931.

Figure 7:
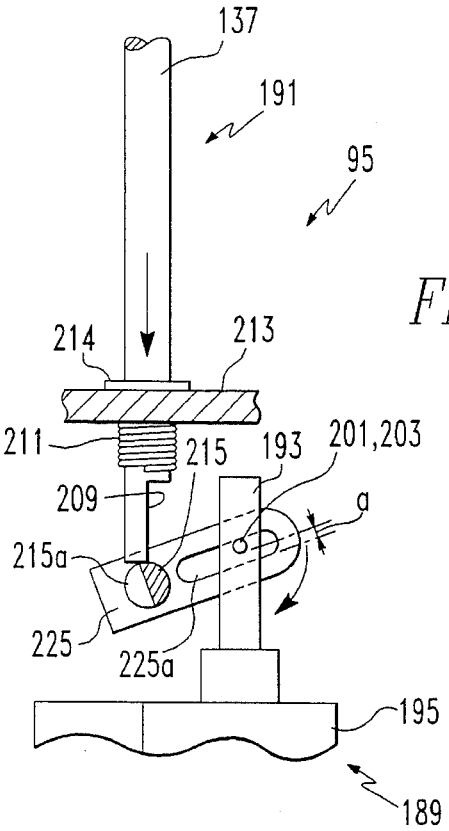
FIG. 7 is a schematic view showing the relationship of the actuating rod with the other components of the trip device of FIG. 6 when in the latched position of FIG. 3.
Figure 8:
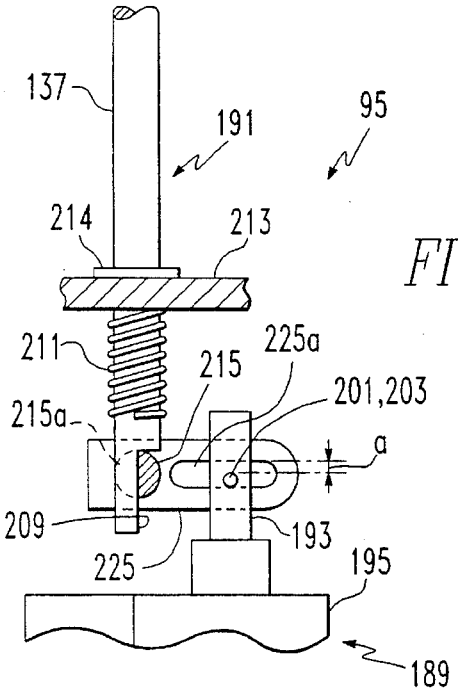
FIG. 8 is a schematic view showing the relationship of the actuating rod with the other components of the trip device of FIG. 6 when in the tripped position of FIG. 5.

The teachings of the present invention will now be given with reference to FIGS. 6, 7, and 8. As shown particularly in FIG. 6, trip device 95 is comprised of a housing generally indicated at 179 having a base 181 and a cover 183. Cover 183 has an under lip 185 which seats against a ledge 187 in base 181. Trip device 95 further comprises a solenoid means 189, and actuator means 191 which even though not shown in FIG. 6 is located adjacent to solenoid means 189 as shown in FIGS. 7 and 8 in housing 179 of trip device 95, and which actuator means 191 is mechanically operated by solenoid means 189.

Solenoid means 189 is a commercially available commodity, and is generally known as an open frame solenoid. As is well-known in the art, in general, a solenoid consists of a cylindrical coil of insulated wire in which an axial magnetic field is established by a flow of electrical current and a metal core which slides along the coil axis under the influence of the magnetic field.

Similarly, solenoid means 189 has a core 193 which preferably is made of metal. Solenoid means 189 further consists of a frame 195 shown in FIG. 6 which houses the cylindrical coil of insulated wire (not shown) and which is configured to place and fix frame 195 of solenoid means 189 properly in base 181 in the usual fashion.

Figure 6:
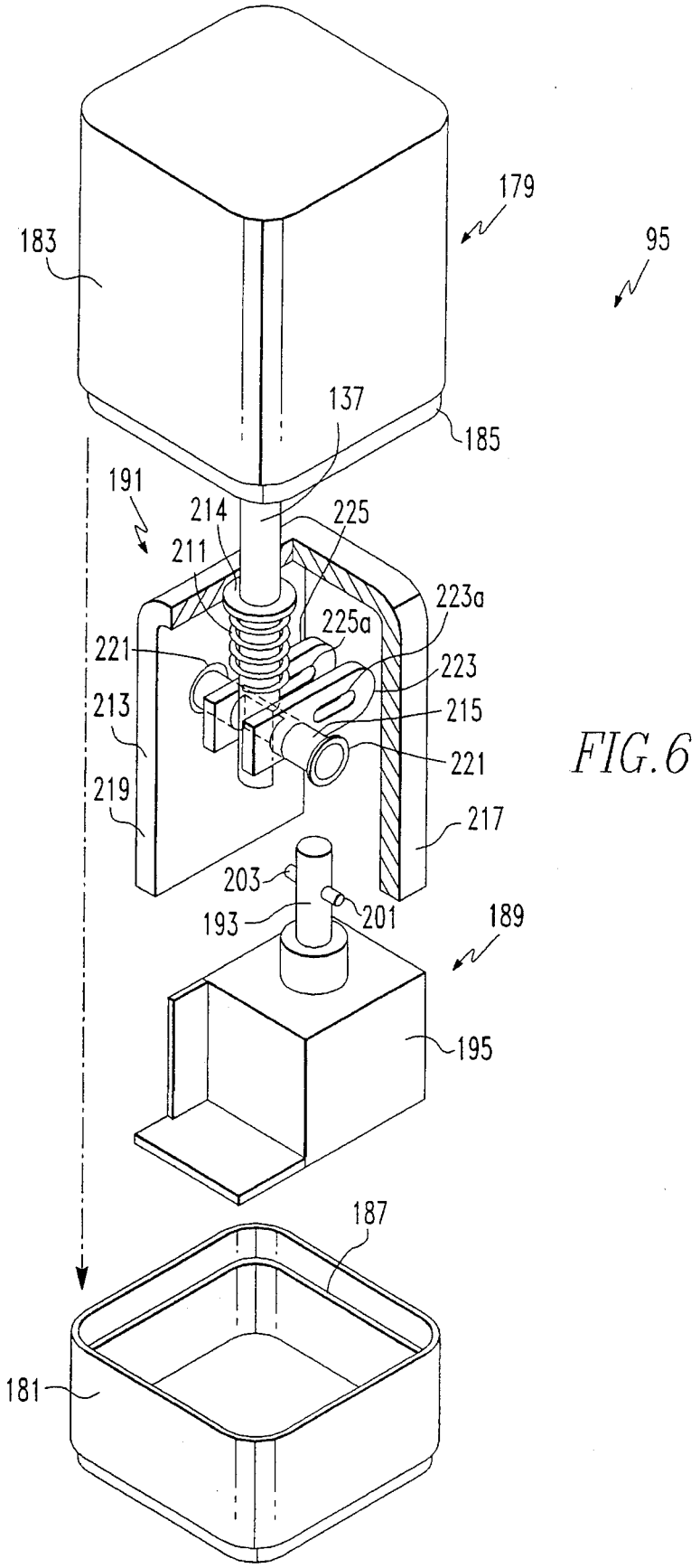
FIG. 6 is a perspective, exploded view of the trip device of the present invention shown in FIG. 3.

As shown particularly in FIG. 6, the outer end of core 193 has projections 201,203 extending outwardly from core 193 which projections 201,203 are, in effect, a pin pressed through core 193.

Still referring to FIG. 6, actuator means 191 for trip device 95 is comprised of the biased actuating rod 137 which is biased by a spring 211 which is in an uncompressed state in FIG. 6; an inverted U-shaped bracket 213 which is partially broken away for clarity purposes and in which actuating rod 137 extends by way of a beating member 214; a rotatable shaft 215 mounted in legs 217 and 219 of bracket 213 by bearings 221; and opposed latch arms 223 and 225 fixedly mounted on shaft for rotation therewith, and having an elongated slot 223*a*, 225*a*, respectively.

Spring 211 may be fixedly attached to an undersurface of bracket 213 at its one end and fixedly attached in actuating rod 137 at its other end for effecting the compressed and uncompressed states for spring 211 in FIGS. 7 and 8, respectively.

FIGS. 7 and 8 particularly show actuator means 191 and solenoid means 189 of trip device 95 in assembled form. For simplicity, only latch arm 225 is shown in FIGS. 7 and 8 relative to actuating rod 137 and solenoid means 189, but it is to be understood that latch arm 223 of FIG. 6 operates in the same manner as latch arm 225. In assembled form, it is to be appreciated that core 193 of solenoid means 189 is located between latch arms 223 and 225 and projections 201,203 of core 193 extend in a respective elongated slot 223*a*, 225*a* of latch arms 223,225. That is, projection 201 extends into elongated slot 223*a* of latch arm 223 and projection 203 extends into elongated slot 225*a* of latch arm 225.

As shown in FIG. 7, projections 201,203 are spaced away from a lower edge of elongated slots 223*a*, 225*a* of latch arms 223, 225 to form a gap "a" therebetween.

Shaft 215 has a notch portion 215*a* along its axial length which cooperates with a notched end 209 of actuating rod 137. As shown in FIG. 7, the notched end 209*a* of actuating rod 137 abuts against shaft 215 in close proximity to notch portion 215*a* of shaft 215 in a reset position for trip device 95 as discussed with references to FIG. 3 and 4, whereby the electrical contacts 21 and 23 are in an open and a closed position.

In referring to FIGS. 7 and 8, when solenoid means 189 receives an electrical pulse representing a fault condition in circuit breaker 5, its core 193 is caused to move axially into solenoid housing 195 (FIG. 8). In this movement, projections 201,203 contact the lower edge of elongated slots 223*a*, 225*a* in latch arms 223,225, causing latch arms 223,225 with shaft 215 to rotate in a clockwise direction as shown by the arrow in FIG. 7. This rotation of latch arms 223,225 and shaft 215 aligns notched portion 215*a* of shaft 215 with the notched end 209 of actuating rod 137. Through the charged energy of spring 211, actuating rod 137 axially moves into the notched portion 215*a* of shaft 215 to produce the tripped position for trip device 95 as represented in FIG. 5. This is schematically represented in FIG. 8 for the main components of trip device 95 which results in the opening of electrical contacts 21 and 23 of FIGS. 1 and 2.

In FIG. 8, the notched end 209 of actuating rod 137 is positioned within notched portion 215*a* of shaft 215, with spring 211 around shaft 215 being in an uncompressed state. Latch arms 223,225 are generally horizontal, and projections 201,203 are abutting the lower edge of elongated slots 223*a*, 225*a* of latch arms 223, 225 with gap "a" now existing between projections 201,203 and an upper ledge of elongated slots 223*a*, 225*a* in latch arms 223,225.

Resetting of trip device 95 is achieved through operation of resilient bell-crank reset member 145 as discussed hereinabove and as taught in the aforementioned U.S. Pat. No. 3,544,931.

With particular reference to FIG. 8, in the resetting process for trip device 95, reset member 145 of FIGS. 3–5 moves actuating rod 137 upwardly and notched end 209 of rod 137 exits out of notch portion 215*a* of shaft 215 with spring 211 being compressed as shown in FIG. 7.

In this process, core 193 of solenoid means 189 is moved upwardly by a spring (not shown) out of solenoid means 189 which, in effect, causes projections 201,203 on core 193 to engage the upper edges in elongated slots 223,225 to rotate in a counterclockwise direction relative to FIG. 8. This action, of course, rotates shaft 215 also in a counterclockwise direction relative to FIG. 8 and positions the notched portion 215*a* of shaft 215 in its positioning of FIG. 7 abutting against the edge of notched end 209 of actuating rod 137.

Preferably, the distance for gap "a" of FIGS. 7 and 8 is about 0.03 inches, but may range between from about 0.006 inches to about 0.2 inches. The distance of this gap "a" is important in that it establishes the required instantaneous velocity for core 193 in at least its downward travel to sufficiently impart an impact force of projections 201,203 against latch arms 223 and 225 to overcome the normal and frictional forces of these components of trip device 95 and to rotate latch arms 223 and 225 in a clockwise direction from their position shown in FIG. 7 to that shown in FIG. 8 and in a counterclockwise direction from their position shown in FIG. 8 to that shown in FIG. 7.

This instantaneous velocity is derived from the kinetic energy theory and the following equations:

$$KE=W \tag{1}$$

where KE is the kinetic energy of moving core 193 and W is the work needed to trip latch arms 223 and 225. The kinetic energy, KE, is equal to $\frac{1}{2}mv^2$ and the work, W, is equal to fnd. Substituting these values into equation (1) yields $$\tfrac{1}{2}my^2=fnd \tag{2}$$

This equation is solved for the velocity, v such that:

$$v=\left(2\frac{fnd}{m}\right)^{1/2} \tag{3}$$

In these two equations (2) and (3), v is the required instantaneous velocity for core 193 when it contacts latch arm 223,225; f is the coefficient of friction between shaft 215 and actuator rod 139; n is the normal force for actuating rod 137 against shaft 215, d is the distance of the gap "a" between projections 201,203 and the lower or upper edge of elongated slots 223*a*, 225*a* in latch arms 223,225, and m is the moving mass of core 193. As an example, the moving mass, m, for core 193 may be about 0.5 ounces, a coefficient of friction, f, for core 193 and shaft 215 may be about 0.3, and the normal force, n, may be about 5 pounds.

The improved design of trip device 95 provides a more reliable actuation, voltage and holding force for trip device 95 compared to the trip devices of the prior art. For instance, the trip device 95 of the present invention is tripped when 19 volts are applied in a 100 microfarad capacitor. The prior art trip devices consist of a permanent magnet, and are tripped when 15 to 25 volts are applied, or are accidentally tripped due to shock and vibration in the system.

From the above it can further be appreciated that the improved design for trip device 95 is less expensive, less sensitive to shock and vibrations, and easier to manufacture compared to the trip devices of the prior art.

Whereas, particular embodiments of the invention have been described above for purposes of illustration, it will be appreciated by those skilled in the art that numerous variations of the details may be made without departing from the invention as described in the appended claims.

In accordance with the provisions of the patent statutes, we have explained the principles and operation of our invention and have illustrated and described what we consider to be the best embodiments thereof.

What is claimed:

1. A circuit breaker having a set of electrical contacts which are opened by a circuit breaker mechanism activated by a trip mechanism which, in turn, is activated by a trip device when an overload or an abnormal condition occurs in said circuit breaker, said trip device, comprising:

solenoid means having slidable core means being in a first position when said circuit breaker is operating and being moved in a second position when said overload or abnormal condition occurs, an actuating rod associated with said trip mechanism and positionable in a tripping position for operating said trip mechanism for opening of said electrical contacts, shaft means operatively associated with said actuating rod, latch arm means fixedly mounted to said shaft means and operatively associated with said core means of said solenoid means, wherein said latch arm means includes slot means, wherein said means of said core means are projection means extending into said slot means of said latch means and structured to form a gap in said slot means between said projection means and said latch arm means, and said core means including means being structured to impact against said latch arm means upon said movement of said core means in said second position to effect movement of said latch means and said shaft means in a manner to effect said tripping position of said actuating rod for said operation of said trip mechanism for said opening of said set of electrical contacts.

2. A circuit breaker of claim 1, wherein the distance of said gap between said projection means and said latch arm means is determined according to a predetermined instantaneous velocity for said core means upon said core means in said second position for said impact of said projection means of said core means against said latch arm means.

3. A circuit breaker having a set of electrical contacts which are opened by a circuit breaker mechanism activated by a trip mechanism which, in turn, is activated by a trip device when an overload or an abnormal condition occurs in said circuit breaker, said trip device comprising:

solenoid means having slidable core means being in a first position when said circuit breaker is operating and being moved in a second position when said overload or abnormal condition occurs, an actuating rod associated with said trip mechanism and being positionable in a tripping position for operating said trip mechanism for opening of said electrical contacts and having a notched end, rotatably mounted shaft means located adjacent to said actuating rod and having a notched portion in close proximity to said notched end of said actuating rod which abuts said shaft means for holding said actuating rod in a non-activated condition for said trip device, latch arm means fixedly mounted to said shaft means and located adjacent to said core means of said solenoid means, said core means including projection means positioned in said latch arm means and structured to form a gap between said projection means and said latch arm means when said core means is in said first position and being structured to impact against said latch arm means upon said movement of said core means in said second position to effect rotation of said latch means with said shaft means in a mariner said actuating rod moved into said notched portion of said shaft means for effecting said tripping position of said actuating rod for said opening of said electrical contacts; and wherein said core means moves into its said second position according to a predetermined instantaneous velocity based on the kinetic energy in said trip device such that said impact of said core means against said latch arm means is sufficient to overcome the normal and frictional forces in said trip device for said obtaining of said tripping position of said actuating rod of said trip device.

4. A circuit breaker having a set of electrical contacts which are opened by a circuit breaker mechanism activated by a trip mechanism which, in turn, is activated by a trip device when an overload or an abnormal condition occurs in said circuit breaker, said trip device, comprising:

solenoid means having slidable core means being in a first position when said circuit breaker is operating and being moved in a second position when said overload or abnormal condition occurs, an actuating rod associated with said trip mechanism and being positionable in a tripping position for operating said trip mechanisms for opening of said electrical contacts and having a notched end, rotatably mounted shaft means located adjacent to said actuating rod and having a notched portion in close proximity to said notched end of said actuating rod which abuts said shaft means for holding said actuating rod in a non-activated condition for said trip device, latch arm means fixedly mounted to said shaft means and located adjacent to said core means of said solenoid means, said core means including projection means positioned in said latch arm means and structured to form a gap between said projection means and said latch arm means when said core means is in said first position and being structured to impact against said latch arm means upon said movement of said core means in said second position to effect rotation of said latch means with said shaft means in a manner said notched end of said actuating rod is released from said shaft means and said actuating rod moves into said notched portion of said shaft means for effecting said tripping position of said actuating rod for said opening of said electrical contacts, wherein the distance of said gap between said projection means of said core means and said latch arm means is predetermined according to the required instantaneous velocity of said core means when contacting said latch arm means in order to overcome at least the normal and frictional forces in said trip device, and wherein said instantaneous velocity is defined by the following equation:

$$v = \left[ \frac{2fnd}{m} \right]^{1/2}$$

where v is the required instantaneous velocity for said core means when contacting said latch arm means, f is the coefficient of friction between said shaft means and said actuating rod, n is the normal force of said actuating rod against said shaft means, d is the distance of said gap between said projection means of said core means and said latch arm means, and m is the moving mass of said core means.

5. A circuit breaker of claim 2, wherein said actuating rod and said shaft means are in physical contact with each other, and wherein said predetermined instantaneous velocity for said core means is defined by the following equation:

$$v = \left( 2 \frac{fnd}{m} \right)^{1/2}$$

where v is said predetermined instantaneous velocity for said projection means when contacting said latch arm means, f is the coefficient of friction between said shaft means and said actuating rod, n is the normal force of said actuating rod against said shaft means, d is the distance of said gap between said projection means of said core means and said latch arm means, and m is the moving mass of said core means.

6. A circuit breaker of claim 5, wherein said distance of said gap is about 0.03 inches.

7. A circuit breaker of claim 5, wherein said normal force is about 5 pounds, said coefficient of friction is about 0.3, and said mass is about 0.5 ounces.

8. A circuit breaker of claim 5, wherein said distance of said gap is in a range of about 0.006 inches to about 0.2 inches.

9. A circuit breaker of claim 4, wherein said distance of said gap is about 0.03 inches.

10. A circuit breaker of claim 4, wherein said normal force is about 5 pounds, said coefficient of friction is about 0.3, and said mass is about 0.5 ounces.

11. A circuit breaker of claim 4, wherein said distance of said gap is in a range of about 0.006 inches to about 0.2 inches.

* * * * *